US007908974B2

(12) United States Patent
Hewitt et al.

(10) Patent No.: US 7,908,974 B2
(45) Date of Patent: Mar. 22, 2011

(54) RAILWAY BOGIES

(75) Inventors: Paul Hewitt, Sao Gregoria (PT); Wayne Jamieson, Leven (GB)

(73) Assignee: SCT Technology, LLC, Wilmington, DE (US)

( * ) Notice: Subject to any disclaimer, the term of this patent is extended or adjusted under 35 U.S.C. 154(b) by 559 days.

(21) Appl. No.: 11/794,388

(22) PCT Filed: Jan. 6, 2006

(86) PCT No.: PCT/GB2006/000052

§ 371 (c)(1),
(2), (4) Date: Feb. 4, 2008

(87) PCT Pub. No.: WO2006/072800

PCT Pub. Date: Jul. 13, 2006

(65) Prior Publication Data

US 2009/0031918 A1 Feb. 5, 2009

(30) Foreign Application Priority Data

Jan. 7, 2005 (GB) ..... 0500236.5

(51) Int. Cl.
*B61F 5/30* (2006.01)
*B61F 5/36* (2006.01)

(52) U.S. Cl. ..... 105/224.05; 105/198.2; 105/218.1; 303/22.7

(58) Field of Classification Search ..... 105/182.1, 105/185, 218.1, 224.05, 224.06, 224.1, 194, 105/195, 209; 303/22.1–22.8
See application file for complete search history.

(56) References Cited

U.S. PATENT DOCUMENTS

| | | | | | |
|---|---|---|---|---|---|
| 2,132,387 | A | * | 10/1938 | Barrows | 105/224.05 |
| 2,355,450 | A | * | 8/1944 | Leese | 105/224.06 |
| 2,900,924 | A | * | 8/1959 | Furrer et al. | 105/199.5 |
| 3,862,606 | A | * | 1/1975 | Scales | 105/167 |
| 3,915,095 | A | | 10/1975 | Briggs | |
| 3,936,097 | A | * | 2/1976 | Yanagawa et al. | 303/22.8 |
| 4,133,268 | A | | 1/1979 | Guillaumin | |

(Continued)

FOREIGN PATENT DOCUMENTS

| | | |
|---|---|---|
| EP | 0 443 953 A1 | 8/1991 |
| GB | 2 078 646 A | 1/1982 |

OTHER PUBLICATIONS

Brochure of AM$^{III}$ Bogie, Probotec S.A.R.L.

*Primary Examiner* — S. Joseph Morano
*Assistant Examiner* — Zachary Kuhfuss
(74) *Attorney, Agent, or Firm* — Bishop & Diehl, Ltd.

(57) ABSTRACT

This invention relates to bogies for railway rolling stock. In particular it relates to suspension arrangements for such bogies wherein the frame is mounted on a spring suspension arrangement. In one embodiment the spring suspension arrangement comprises two groups of springs on either side of a wheel axle (11), each group comprising an inner spring (14) and two outer fore and aft springs (15, 16). In another arrangement there are two lower springs (14) on either side of a wheel axle (11) and at least one upper spring (21) above the axle. The arrangements described provide better lateral and longitudinal stiffness and shear characteristics which, reduce hunting and wheel wear. They also enable the axles to accommodate increased loads.

14 Claims, 7 Drawing Sheets

U.S. PATENT DOCUMENTS 4,676,172 A * 6/1987 Bullock ..... 105/168
4,771,704 A * 9/1988 Gronlund et al. ..... 105/193
4,932,330 A 6/1990 Herring, Jr.
5,176,083 A 1/1993 Bullock
5,239,932 A 8/1993 Weber
5,522,468 A * 6/1996 Dohrmann et al. ..... 177/136
5,611,284 A 3/1997 Smith et al.
6,092,469 A * 7/2000 Monsell ..... 105/165
7,320,257 B2 * 1/2008 Takizawa et al. ..... 73/862.541
2004/0251058 A1 12/2004 Carr et al.
2005/0275279 A1 * 12/2005 Ring ..... 303/9.69
2008/0264292 A1 * 10/2008 Aitken ..... 105/198.4

* cited by examiner

RAILWAY BOGIES

The present invention relates to bogies for railway rolling stock, and particularly but not solely to bogies for railway freight wagons.

Railway bogies typically comprise a generally rectangular frame, arranged to be mounted via a bearing to the underside of the railway wagon chassis for turning about a central vertical axis, this bogie frame being mounted on a pair of wheelsets, each consisting of an axle having a wheel and a bearing fixed to it adjacent to each of its opposite ends. The wheelset is attached to the bogie frame via a saddle or axlebox assembly which encloses the bearing at each end of the wheelset. The saddle or axlebox has a number of coil suspension springs standing vertically. The bogie frame is provided with pedestal formations adjacent its four corners, the four pedestals being supported on the upper ends of the suspension springs of the four saddle or axlebox assemblies. This suspension arrangement is known as a primary suspension.

In current arrangements, the suspension springs are disposed at a common level, either above or below the level of the axle centreline, such that the suspension therefore has a single plane of spring interaction and the springs can both shear and bend. In some other suspensions, the springs are arranged purely to bend in their axial planes. In considering the response of a helical coil spring to a lateral force, the deflection due to the bending moment and the deflection produced by the shearing force both have to be taken into account. In the case of a free helical spring supported flat at each end, the lateral force response can be considered equal at the 0, 90, 180 and 270 degree directions. The lateral spring rate varies with the seating conditions of the spring ends and with their rocking behaviour.

We have now devised bogies which exhibit improved performance in response to forces to which, in use, the suspension springs are subjected, such that the bogie exhibits improved self-steering and more easily absorbs lateral forces.

In accordance with the present invention, there is provided a railway bogie which comprises a bogie frame supported on each wheelset axle end by a suspension arrangement the springs of which exhibit a first overall response to forces laterally of the bogie and a second, different response to forces longitudinally of the bogie.

In one embodiment, the springs of each suspension arrangement exhibit a first overall stiffness against forces laterally of the bogie, and a second, lower, overall stiffness against forces longitudinally of the bogie: the springs thus exhibit less deflection laterally than longitudinally. As a result, the bogie wheelset exhibits good resistance to lateral movement or hunting on straight track, and moves more readily longitudinally on curved track, so exhibiting improved self-steering. As a consequence, wheel wear is reduced.

In one embodiment, each suspension arrangement comprises two inner springs, one either side of the wheelset axle, and two outer springs each side of the axle, further from the axle than the inner springs. Preferably the inner spring and two outer springs, each side of the axle, are arranged as a group in a triangle. Preferably each of the inner springs has twice the axial stiffness of each of the outer springs of the same group, so that the axial stiffness of the inner spring is matched by the combined axial stiffnesses of the two outer springs. Preferably the bogie frame rests on the tops of the inner springs via respective friction wedges, which give the bogie a floating control property, providing vertical and lateral friction damping, thus permitting and damping longitudinal or yaw motion of the wheelset.

In a second embodiment, each suspension arrangement comprises two lower springs, one either side of the wheelset axle, and at least one upper spring disposed above the wheelset axle. In this arrangement, the overall stiffness against forces laterally of the bogie is relatively high. The bogie frame preferably rests on the tops of the lower springs via respective friction wedges. Preferably the upper springs are constrained, over part of their lengths, such that pure shear will take place in the lateral plane.

It is preferred that the suspension arrangements of either the first or second embodiments of the invention include a proportional load valve (PLV) to measure apparent load on an axle.

It is envisaged that the proportional load valve is fitted in vertical alignment with an axle, preferably substantially above a suspension spring fitted to a suspension frame or is arranged to measure the load applied directly through the axle e.g. by being connected to a point in the plane passing through the vertical centreline of the axle by a one to one lever.

Preferably, the proportional load valve sends a pneumatic signal to a brake control valve which controls the force applied to brake blocks acting on the wheels.

Conventional railway bogie friction wedges have their inclined contact surfaces cambered or convex-curved from end-to-end, but these surfaces are straight across the width of the wedge. Preferably, the inclined contact surface of each friction wedge is cambered or convex-curved both longitudinally and transversely, providing a generally domed surface and therefore a reduction in the contact area and an increase in mean maximum pressure thereby reducing resistance to longitudinal movement of the wheelset: this leads to a further improvement in the self-steering performance of the bogie.

Also in accordance with the present invention, there is provided a friction wedge for a railway bogie suspension, the inclined contact surface of the wedge exhibiting convex curvature both longitudinally and transversely.

In a further embodiment of the invention there is provided a welded connection between parts of a bogie frame. It is envisaged that the welded connection between a bolster and side frame is provided by a full penetration butt weld.

Embodiments of the present invention will now be described by way of examples only and with reference to the accompanying drawings, in which.

Figure 1:
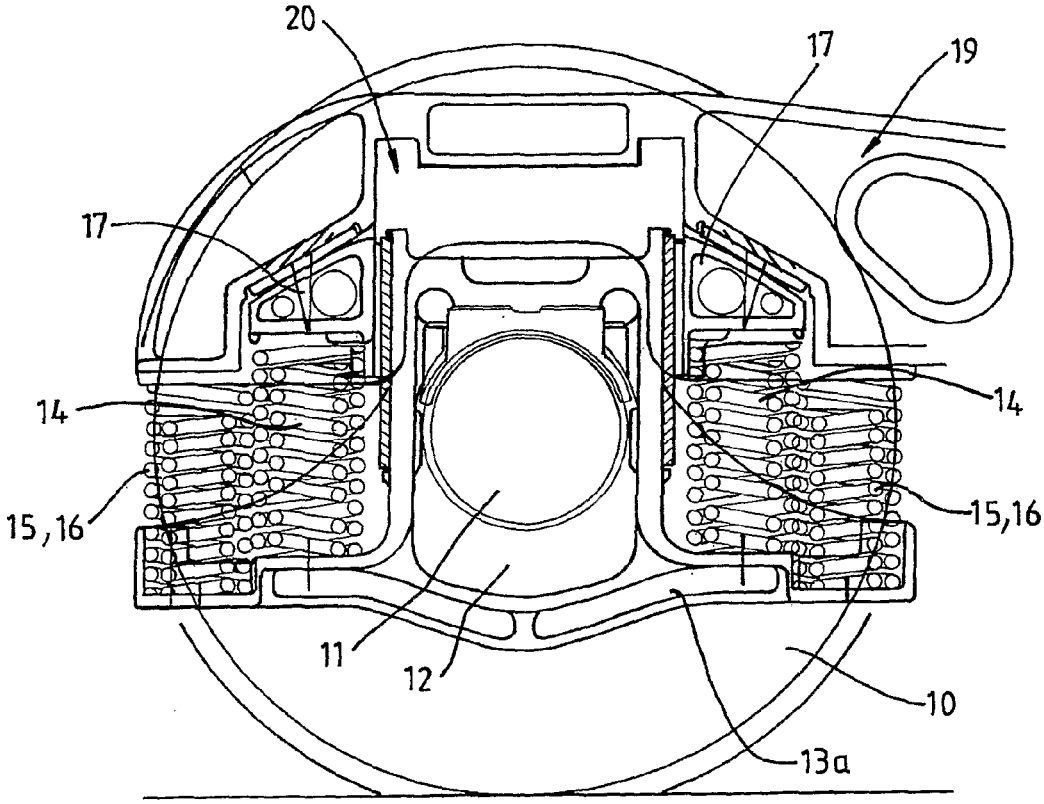
FIG. 1 is a side view of the suspension arrangement at one corner of a first embodiment of self-steering railway bogie in accordance with the present invention.
Figure 2:
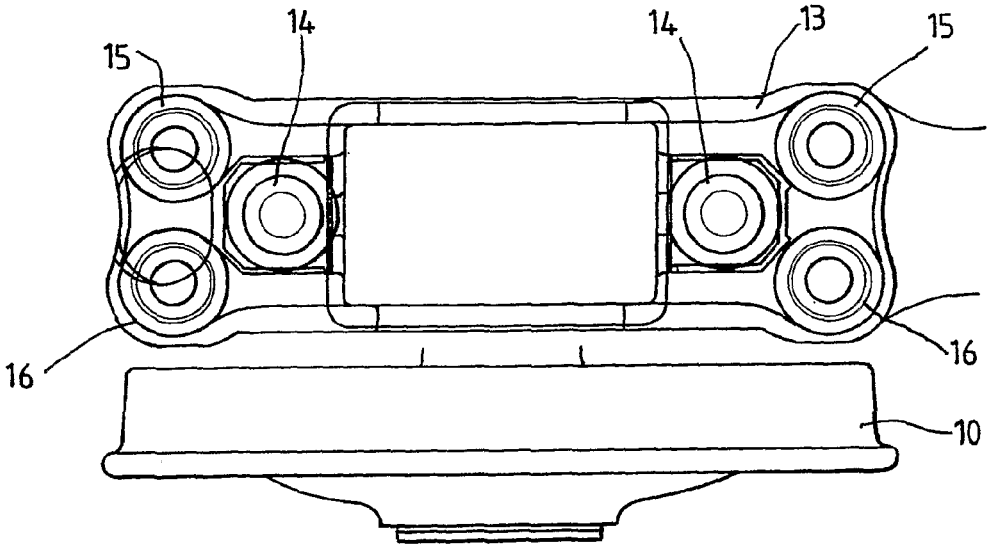
FIG. 2 is a plan view of the arrangement shown in FIG. 1.

Referring firstly to FIGS. 1 and 2 of the drawings, a self-steering bogie comprises two wheelsets, one wheel of one such wheelset being shown at 10. A saddle or axlebox assembly is mounted to the end of the axle of the wheelset via a bearing 11 and a bearing adapter 12, the saddle 13*a* or axlebox assembly 13*b*, (see FIG. 3) collectively referred to as 13 which provides flat seats, to either side of the axle, for respective sets of coiled suspension springs. Each set of suspension springs comprises three such springs, namely a first or inner spring 14, adjacent the axle, and then second and third or outer springs 15,16 which are disposed side-by-side, parallel to the axle, further from the axle than the first spring 14 and symmetrically to either side of that spring. The bases of the suspension springs are all below the axle centreline and may be all on the same level as each other, or slightly offset: for example, in the embodiment shown, the bases of the inner springs 14 are at a slightly higher level than the bases of the outer springs 15,16. The inner springs 14 support respective friction wedges 17, the upper surfaces of which are inclined downwardly away from the axle. The bogie further comprises a generally rectangular frame 19, arranged to be mounted via a bearing to the underside of the wagon chassis for turning about a central vertical axis in conventional manner: the bogie frame is provided with a pedestal formation 20 adjacent each of its four corners. The pedestal 20 is supported directly on the upper ends of the suspension springs 15,16 and indirectly, via the friction wedges 17, on the upper ends of the suspension springs 14.

It will be appreciated that bogie suspension uses a floating control wedge principle, the arrangement of the friction wedges providing vertical and lateral friction damping and permitting and damping longitudinal or yaw motion of the respective wheelset. The inner springs 14 have twice the axial stiffness of each of the outer springs 15,16, throughout the spring travel: thus the stiffness of the single inner spring 14 is matched by the combined stiffness of the two outer springs 15, 16, in each triangular group or nest of three: as a result, the damping factor provided by the friction wedges is maintained at the required level. It will be appreciated that the centre of resistive movement of each triangular group of springs is displaced to the centre of the triangle and this effectively increases the overall lateral stiffness: in particular, the overall lateral stiffness of each triangular group of springs is greater than the combined lateral stiffnesses of the individual springs of the group, whilst the overall longitudinal stiffness of the group is less than the combined lateral stiffness of the individual springs of the group. Lateral vehicle generated forces are accordingly resisted, by shear and bending of the groups of springs, to a greater degree than longitudinal track-generated (traction and creepage) forces. Consequently, each wheelset of the bogie is more resistant to lateral movement or hunting on straight track, and more ready to move longitudinally on curved track, giving good self-steering properties. As a further consequence, wheel wear is reduced.

Figure 3:
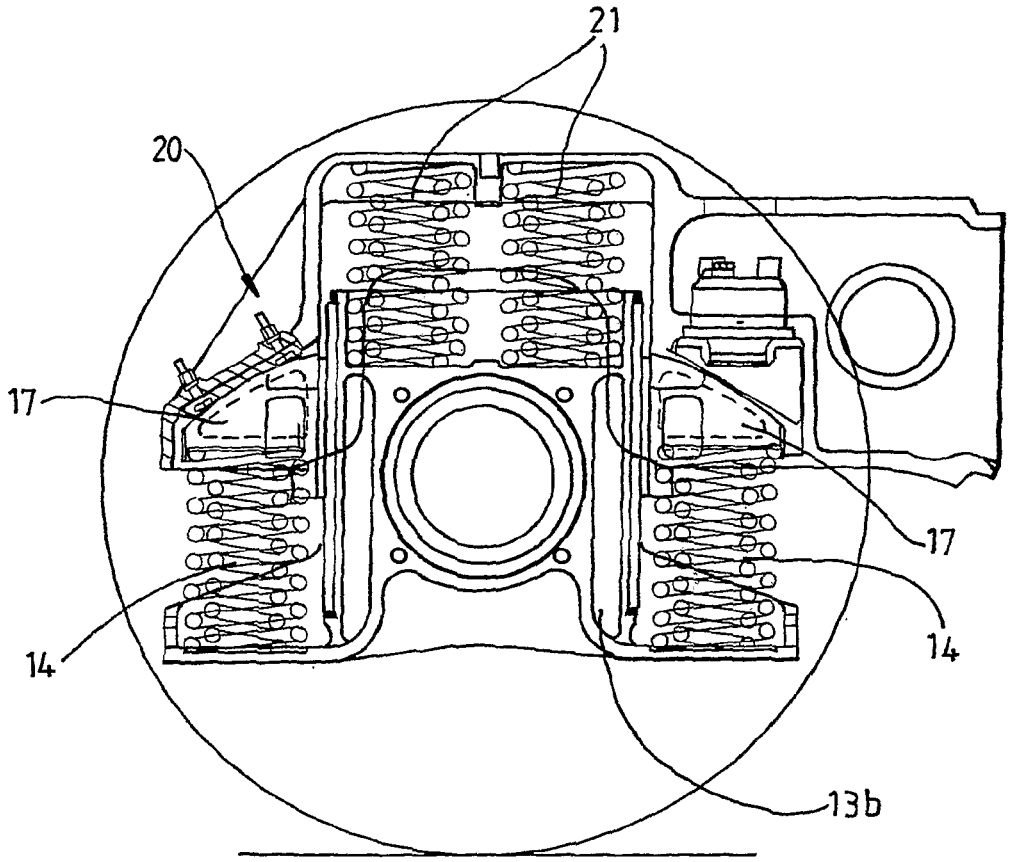
FIG. 3 is a view, similar to FIG. 1, of the suspension arrangement of a second embodiment of self-steering railway bogie in accordance with the present invention.
Figure 4:
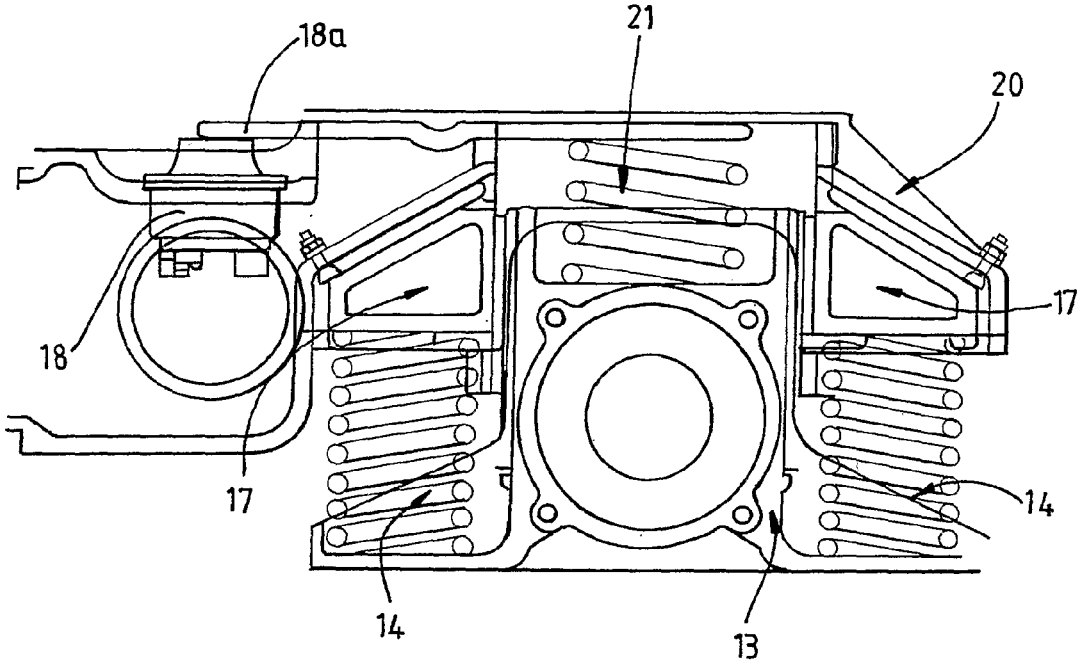
FIG. 4 is a side view of the suspension arrangement at one corner of a modified second embodiment of self-steering railway bogie in accordance with the present invention.

FIG. 3 shows the suspension arrangement of a second embodiment of bogie in accordance with the present invention and parts thereof which correspond to parts of the bogie shown in FIGS. 1 and 2 are denoted by the same reference numerals. The suspension arrangement shown in FIG. 3 differs from that shown in FIGS. 1 and 2 by comprising different springs respectively above and below the axle centreline, which increases control of the lateral and longitudinal movements of the wheelset and hence the dynamic performance of the bogie. In particular, the suspension comprises two springs 21 which have their bases seated flat on the saddle or axlebox 13 above the axle, and two springs 14, one either side of the axle, which have their bases seated flat on the saddle or axlebox 13 below the axle centreline: all four springs 14,21 are aligned in the same longitudinal plane. The respective pedestal 20 of the bogie frame is supported directly on the upper ends of the springs 21 and indirectly, via friction wedges 17, on the tops of the springs 14. In a modification, the two upper springs 21 may be replaced by a single such spring. In either case, the upper spring, or upper springs overall, have a higher lateral spring rate than the lower springs.

It will be appreciated that by disposing the springs 21 almost directly over the axle, the bogie frame can accommodate a much greater load, for a particular spring of given dimension and rate, than they could in the conventional arrangement where such springs sit outside the inner wedge supporting springs. This is important, because the trend is towards a requirement to support greater loads per axle than before.

It will also be observers that the distance between the axis of the axle and the centres of the springs 21 and 14 respectively are different. Consequently the different moments of the springs results in different longitudinal stiffness resulting from the springs. A similar effect is achieved in FIG. 1 by having the basis of the springs 15, 16 lower than those of springs 14, as previously mentioned.

In FIG. 3 a proportional load valve (PLV) 18 measures the apparent load on an axle and sends a pneumatic signal to the brake control valve which in turn controls the force, in response to the measured pressure, applied to the brake blocks which act on the wheels to slow the wagon. When the wagon is unloaded, for example, this prevents 'over braking' and hence reduces the likelihood of flats being formed on the wheel.

The signal from the PLV 18 is generated by the compressive load applied to the coil suspension springs 14,15,16 located in the saddle or axlebox assembly. The PLV is located on the top of one of the coil suspension springs. This can lead to margins of error in recording the load acting on the axle.

Normally, each bogie has a PLV. The load acting on a bogie is half the total mass of the wagon. A bogie has two axles therefore each axle sees one quarter of the total mass of the wagon. This is where the margin of error can arise. If the PLV is located on top of one of the suspension springs it actually sees either a quarter of the load acting on the axle. in the case of Y25 bogie i.e. one spring either side of the saddle or axle box or an eighth of the load acting on the axle in the case of an Axle Motion Bogie i.e. two springs on either side of the saddle or axle box. The error can arise because it is possible for the springs to he compressed in an unequal manner i.e. one side of the saddle or axle box could be compressed more than the other because of track deformities etc.

In a preferred arrangement the PLV to he fitted immediately above the axle when one spring is located above the centreline of the axle therefore to measure directly one quarter of the load acting on the axle or it can he fitted on the bogie frame and actuated by a 1:1 ratio lever 18*a*, which responds to the load applied to the axle on its vertical centreline. If two springs are used directly above the axle a 1:0.5 ratio lever activated by both springs simultaneously measures on a quarter of the axle load. The novel approach of direct load sensing over the axle eliminates the margin of error associated with traditional load sensing from the side of the saddle or axlebox.

The floating control arrangement of the friction wedges again provides vertical and lateral friction damping and permits and dampens longitudinal or yaw motion of the respective wheelset. Lateral forces are resisted by the upper springs in a double shear plane, such that the bending component of spring flexure is at a minimum. The overall lateral spring rate is relatively high such that the wheelset is better able to resist rail-to-wheel lateral forces and, in particular, any tendency for hunting on straight track. When subjected to longitudinal forces, the upper and lower springs deflect readily due to the combined action of bending moment and shear on two planes spaced about the axle centreline: the upper springs deflect, overall, at a lower rate than the lower springs, due to the axle forces on the saddle or axlebox causing rotation; the effect is a lowering of the overall spring rate, producing easier longitudinal wheelset steering. In either condition of lateral or longitudinal loading or forces, the response of the suspension to vertical loads is unchanged, as the vertical spring rates are equal for all springs.

The bases of the springs rest flat and planar on their supports and, on the upper springs, they are constrained over part of their lengths such that pure shear will take place in the lateral planes. As has been previously mentioned, the lateral load portion on the upper spring plane is greater than on the lower spring plane, due to a larger bending couple from the top of the upper spring seat to the axle centreline. There is a larger load at the bases of the upper springs due to the larger bending couple, as the saddle or axlebox is caused to move in a level and co-planar manner under the action of lateral loads. However, bending is restricted and the overall lateral spring rate is increased because of the predominant shearing action, giving greater stability of the wheelset particularly when running in tare on straight track. Under longitudinal forces, the spring seats are still flat and planar but their ends are not constrained: the upper springs have a larger bending moment, for the reasons previously explained. In addition, the saddle or axlebox is caused to rotate slightly when displaced longitudinally and a more pure bending of the upper springs results: this is because the upper springs are closer to the vertical centroid of the axle longitudinal motion than the outer, lower springs, which are also under wedge action as a result of the longitudinal displacement. Both the upper and lower springs deflect by bending and in some part shear, with the upper springs taking a larger proportion of the forces and purely bending. The overall lateral spring rate in the longitudinal direction is reduced, leading to relatively easier steering, with the longitudinal forces arising from wheel-to-rail friction on curves, leading to effective self-steering.

Figure 5:
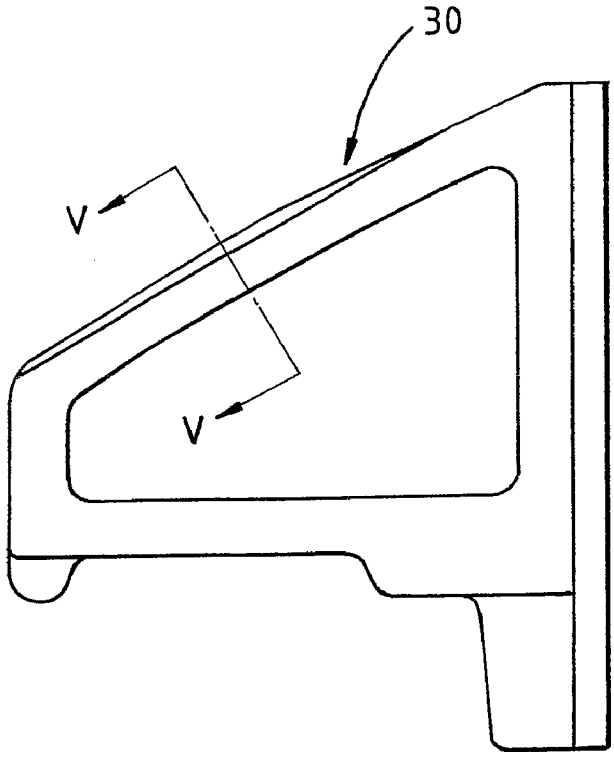
FIG. 5 is a side view of one of the friction wedges used in the suspension arrangements of the bogies shown in FIGS. 1 to 3.
Figure 6:
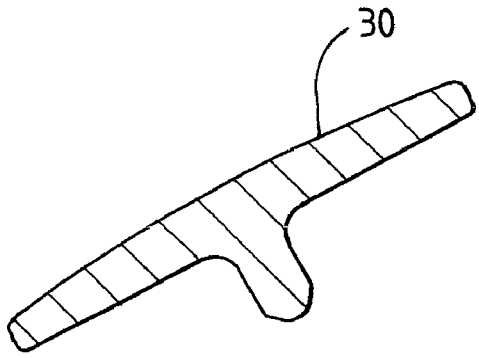
FIG. 6 is a section through the friction wedge, on the line V-V shown in FIG. 4.

FIGS. 5 and 6 show one of the friction wedges used in the suspensions of the two embodiments of bogie which have been described. Conventional friction wedges are cambered along the inclined support surface 30 of the wedge. as shown in FIG. 5, but this surface is straight across the width of the wedge. In accordance with the present invention. the inclined surface 30 is cambered both along the inclined surface 30 of the wedge. and is also cambered across the width of the wedge. as shown in FIG. 6. The surface is thus convex-curved in both its longitudinal and transverse directions. providing a generally domed or spherical contact surface: there is therefore a reduction in the frictional contact area and an increase in the mean maximum pressure and thereby a reduction in the resistance of the wheelset to longitudinal movement and a more ready accommodation of saddle or axlebox rotation in the horizontal plane. These factors lead to a further improvement in the self-steering performance of the bogie.

Figure 7A:
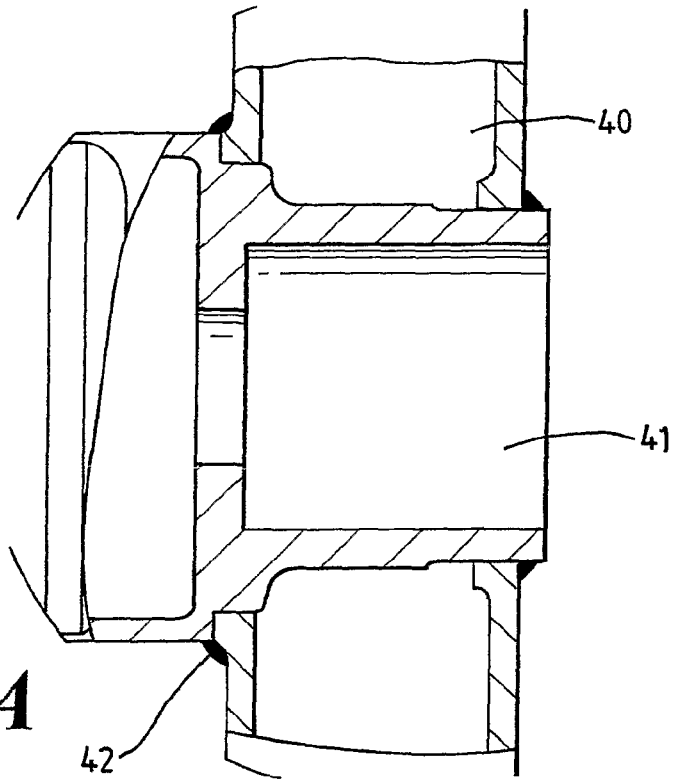
FIG. 7A shows a conventional weld joint between an existing bolster and side frame of a bogie.
Figure 7B:
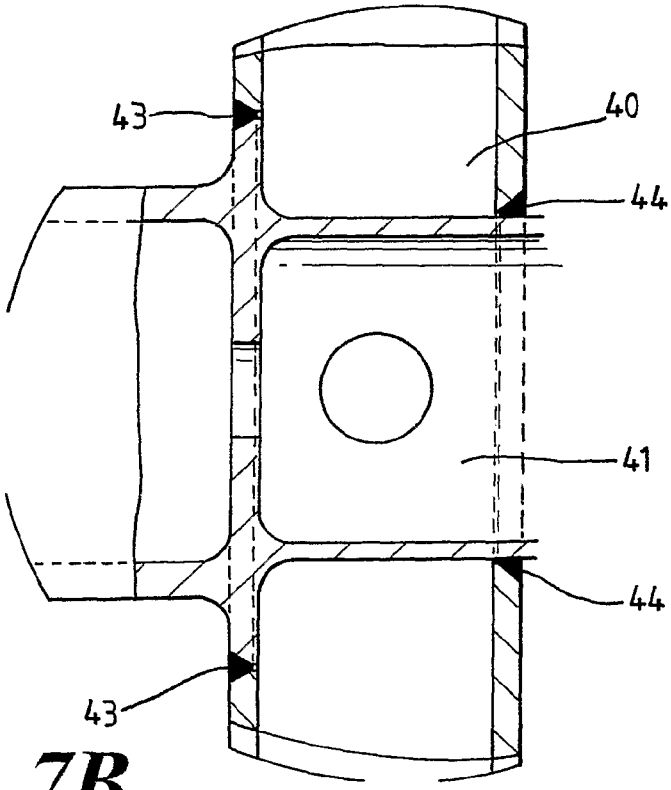
FIG. 7B shows a weld joint used in embodiments of the current invention where a full penetration butt weld is used.
Figure 8:
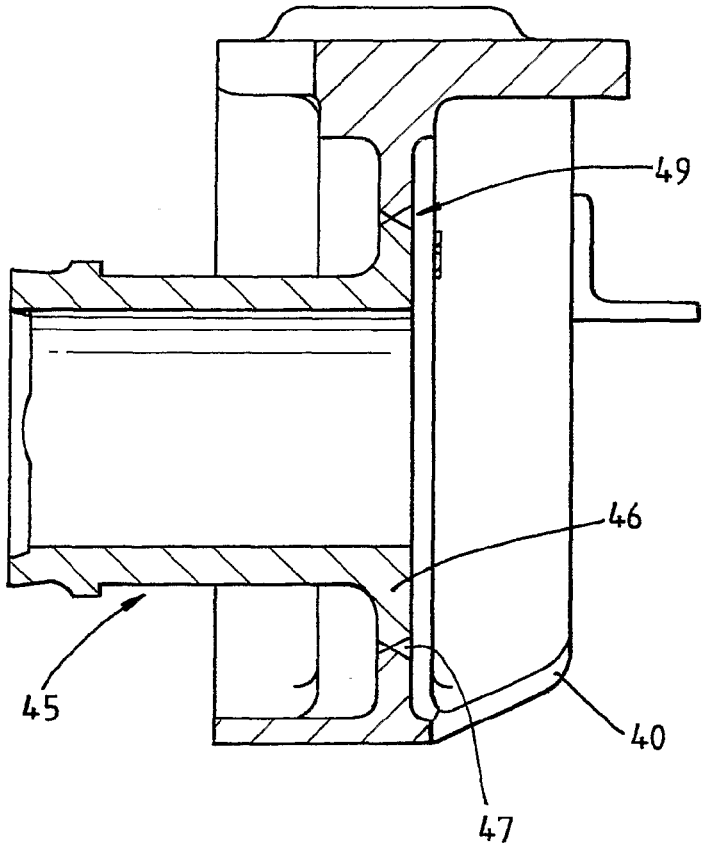
FIG. 8 shows another embodiment where the bolster side frame interface is constructed to form an I-beam with side frame.

The bogie frame accommodates various bogie equipment and in general is fabricated by welding together two side beams, one beam or bolster into an H shaped frame. Conventionally, the welded connection between an existing bolster and a side frame is achieved by fillet welding as shown in FIG. 7A. Side frame 40 is welded to bolster 41 by fillet welds 42. By using fillet welds 42, the allowable stress level permitted on the joint between side frame and bolster is governed by the classification of a fillet weld (fillet welds are low classification welds). However with applicants arrangement as shown in FIG. 7B there is the ability to increase the level of weld classification by using a butt weld, such as a full (or complete) penetration butt weld which gives an increase in the allowable stress. This is achieved by forming part of the inner wall of the frame 40 integrally on the bolster so that the welds 43 are moved outwardly to form butt welds. Further by cutting away the outer walls from 40 further butt welds can be formed at 44. The applicants construction also moves the welded connection into a lower stress region. The combination of improved weld classification and position thereby provides a more structurally efficient design. A further improvement is shown in FIG. 8 where the bolster side frame interface is constructed to form an I-beam with the side frame; the web of the I-beam being located in the plane of the bogie journals.

Thus the bolster 45 is formed with an annular flange 46 that can be disposed within a generally circular aperture 47 of a wall of the side frame 40. The edges of the aperture 47 and the flange 46 are pointed so that they leave appropriate spaces for a circular double sided full pen weld 49.

The strength/weight advantages of I-beams are well known and this novel approach to the interface between the bolster and the side frame takes full advantage of them. Once again it also places the weld in a low stress position and enables a high classification weld to be formed.

The invention is intended to cover not only individual embodiments but also, combinations of the embodiments herein defined.

We claim:

1. A railway bogie including an elongate bogie frame supported on a plurality of wheelset axles by respective suspension arrangements, each arrangement including a plurality of springs on either side of each wheelset axle, comprising an inner spring adjacent each wheelset axle and a pair of fore and aft outer springs, wherein the springs exhibit a first overall response to forces lateral of the bogie and a second different response to forces longitudinal of the bogie the bogie further including a proportional load valve (PLV) for producing an output signal indicative of the load applied to each wheelset axle in its vertical centre plane and wherein the PLV is offset from the centre plane and connected thereto by a 1:1 lever.

2. A bowie as claimed in claim 1 wherein each suspension arrangement exhibits a first overall stiffness against forces lateral of the bogie and a second lower, overall stiffness against forces longitudinal of the bogie.

3. A bogie as claimed in claim 1 wherein the springs are arranged in a triangle.

4. A bogie as claimed in claim 1 wherein the inner spring has twice the axial stiffness of each of the outer springs.

5. A bogie as claimed in claim 4 wherein the bogie frame rests on the top of the inner springs via respective friction wedges.

6. A bogie as claimed in claim 1 wherein each suspension arrangement includes two lower springs one either side of its wheel axle and at least one upper spring disposed above the wheel axle.

7. A bogie as claimed in claim 6 wherein the distance from a centreline of the axle to the centre of the base of the at least one upper spring is less than the distance from the centreline of the axle to the centre of the base of each lower spring.

8. A bogie as claimed in claim 7 wherein the bogie frame rests on the top of the lower springs via respective friction wedges.

9. A bogie as claimed in claim 5 wherein the surface of the friction wedge that supports the frame is cambered or convex curved both longitudinally and laterally.

10. A bogie as claimed in claim 1 further comprising a friction edge for a railway bogie suspension comprising an inclined contact or support surface which is convex curved or cambered both longitudinally and laterally.

11. A bogie as claimed in claim 1 further comprising a railway bogie frame comprising a side frame member and a bolster wherein the contact or contacts between the bolster and the side frame are butt contacts and the bolster and side frame are connected by a full penetration butt weld.

12. A frame as claimed in claim 11 wherein the bolster has an annular flange and the side frame has an aperture for receiving the flange.

13. A frame as claimed in claim 12 wherein the annular flange forms part of an I-beam.

14. A frame as claimed in claim 13 wherein the bolster and side frame are connected by a single generally circular weld.

* * * * *